US006786204B2

(12) United States Patent
Heinrich

(10) Patent No.: US 6,786,204 B2
(45) Date of Patent: Sep. 7, 2004

(54) FIXING DEVICE FOR A FUEL INJECTION VALVE

(75) Inventor: Peter Heinrich, Schwaikheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/466,044

(22) PCT Filed: Jul. 13, 2002

(86) PCT No.: PCT/DE02/02579

§ 371 (c)(1),
(2), (4) Date: Jul. 11, 2003

(87) PCT Pub. No.: WO03/046365

PCT Pub. Date: Jun. 5, 2003

(65) Prior Publication Data

US 2004/0040542 A1 Mar. 4, 2004

(30) Foreign Application Priority Data

Nov. 13, 2001 (DE) ..... 101 55 678

(51) Int. Cl.[7] ..... F02M 61/14
(52) U.S. Cl. ..... 123/470; 123/509
(58) Field of Search ..... 123/470, 468, 123/469, 472, 509

(56) References Cited

U.S. PATENT DOCUMENTS 4,046,478 A * 9/1977 Messerschmidt ..... 403/262
4,206,725 A * 6/1980 Jenkel et al. ..... 123/470
4,901,700 A * 2/1990 Knight et al. ..... 123/470
4,991,279 A * 2/1991 Gaskell ..... 29/281.1
5,794,595 A * 8/1998 Berger et al. ..... 123/470
6,196,194 B1 * 3/2001 Mitchell ..... 123/470
6,431,152 B1 * 8/2002 Estacio ..... 123/470

FOREIGN PATENT DOCUMENTS

DE 26 17 565 3/1977
DE 010025984 A1 * 11/2001
GB 2177157 A * 1/1987 ..... F02M/61/14
JP 2001-65429 A * 3/2001

* cited by examiner

*Primary Examiner*—Weilun Lo
(74) *Attorney, Agent, or Firm*—Ronald E. Greigg

(57) ABSTRACT

A fastening device for fastening a fuel injection valve in a bore in the cylinder head of an internal combustion engine, in which the fuel injection valve has a longitudinal axis. A clamping jaw is acted upon by a fastening force, and the clamping jaw rests with at least one support face on a support point of the fuel injection valve, so that the clamping jaw is pressed with its support face against the support point. The support point on the fuel injection valve (5) is embodied linearly, and the line is straight and in its imaginary extension intersects and is perpendicular to the longitudinal axis of the fuel injection valve.

7 Claims, 5 Drawing Sheets

FIXING DEVICE FOR A FUEL INJECTION VALVE

CROSS-REFERENCE TO RELATED APPLICATIONS

This application is a 35 USC 371 application of PCT/DE 02/02579 filed on Jul. 13, 2002.

BACKGROUND OF THE INVENTION

1. Field of the Invention

The invention is directed to an improved fastening device for a fuel injection valve in a bore in the cylinder head of an internal combustion engine.

2. Description of the Prior Art

One fastening device of the type with which this invention is concerned is known for instance from German Patent DE 195 21 363 C1. In the fastening device shown there, a fuel injection valve is fastened in a bore in the cylinder head of an internal combustion engine, and the fuel injection valve, which has a longitudinal axis, is secured with a clamping jaw. The clamping jaw has a support face, with which it rests on a support point of the fuel injection valve. The clamping jaw is acted upon in its center by a fastening force, and the fastening force is exerted by a screw that presses the clamping jaw against the cylinder head. By means of the fastening force, the clamping jaw is pressed with its support face against the support point of the fuel injection valve and presses the fuel injection valve into the bore in the cylinder head. In DE 19521 363 C1, the support face of the clamping jaw is embodied in ball form and rests on a flat support point of the fuel injection valve. Care is taken here that the point where the clamping jaw rests on the support point of the fuel injection valve is oriented precisely in the direction of the longitudinal axis of the fuel injection valve, so that the fastening force will not cause any tilting moment on the fuel injection valve. However, this cannot always be reliably prevented in the construction shown there: Thermal expansion of the clamping jaw or other parts of the engine, or shaking or shifting, can cause the support face of the clamping jaw to shift on the fuel injection valve, so that the contact pressure is no longer introduced precisely centrally into the fuel injection valve in the direction of the longitudinal axis. The result can be a tilting moment of the fuel injection valve in the bore and hence an uneven mechanical load, which can impair the function of the moving parts in the fuel injection valve considerably.

A similar fastening device is known from U.S. Pat. No. 6,196,194. The clamping jaw shown there also has a ball-like shape on its support face and is embodied as forked, so that it engages two support points of the fuel injection valve which are diametrically opposed to one another. The fastening force is introduced here not in the center of the clamping jaw but rather at the end of the clamping jaw opposite the support face, and the clamping screw pushes the clamping jaw away from the cylinder head. The contact pressure is attained via an abutment on which the clamping jaw rests in its center region. This fastening device likewise has the disadvantage that the contact pressure does not always act centrally on the fuel injection valve, so that as already described, a tilting moment on the fuel injection valve can occur, with the attendant disadvantages.

SUMMARY OF THE INVENTION

The fastening device of the invention for a fuel injection valve has the advantage that the fastening force is always exerted symmetrically on the fuel injection valve, so that the fastening device does not exert any tilting moment, or at most only a very slight tilting moment. To that end, a support point is embodied on the fuel injection valve and forms a straight line, which is located in the same plane as the longitudinal axis of the fuel injection valve. As a result, the fastening force is introduced into a plane of symmetry of the fuel injection valve. The clamping jaw has a support face, which in the event of a horizontal shift, that is, perpendicular to the longitudinal axis of the fuel injection valve, slides across the support point, so that the point where the fastening force is introduced into the fuel injection valve remains fixed.

In an advantageous feature of the subject of the invention, the support face on the clamping jaw is embodied in planar form, so that it can easily slide along the linear support point of the fuel injection valve.

In a further advantageous feature, the clamping jaw is embodied as a two-armed lever, on one end of which the support face is embodied and the other end of which rests at least indirectly on the cylinder head, and the fastening force is introduced between the two ends of the clamping jaw. As a result of this embodiment, the already known clamping jaw can be used for the fastening device of the invention, with a slight modification of the support face.

In an advantageous feature, the linear support point on the fuel injection valve is a ridge which is formed by two chamfers. As a result of this embodiment, the linear support point can be manufactured simply.

In another advantageous feature, two support points diametrically opposed to one another relative to the longitudinal axis are embodied on the fuel injection valve, each embodied as a ridge formed by two chamfers. As a result, the fastening force can be introduced symmetrically on two sides of the fuel injection valve. This is especially advantageous if, on the end where the support face is located, the clamping jaw is embodied as forked.

In a further advantageous feature, the support point on the fuel injection valve is embodied as a jacket line of a support cylinder, whose longitudinal axis intersects the longitudinal axis of the fuel injection valve. This has the advantage that the clamping jaw, if it shifts horizontally, rolls with its support face over the cylinder and thus cannot exert any horizontal forces on the fuel injection valve. As a result, any tilting moments on the fuel injection valve that still occur are reduced still further. It can also advantageously be provided that two support cylinders be disposed coaxially in line with one another, each on one side of the fuel injection valve.

BRIEF DESCRIPTION OF THE DRAWINGS

The foregoing and other features of the invention will become apparent from the description contained herein below, taken in conjunction with the drawings, in which.

DESCRIPTION OF THE PREFERRED EMBODIMENTS

Figure 1:
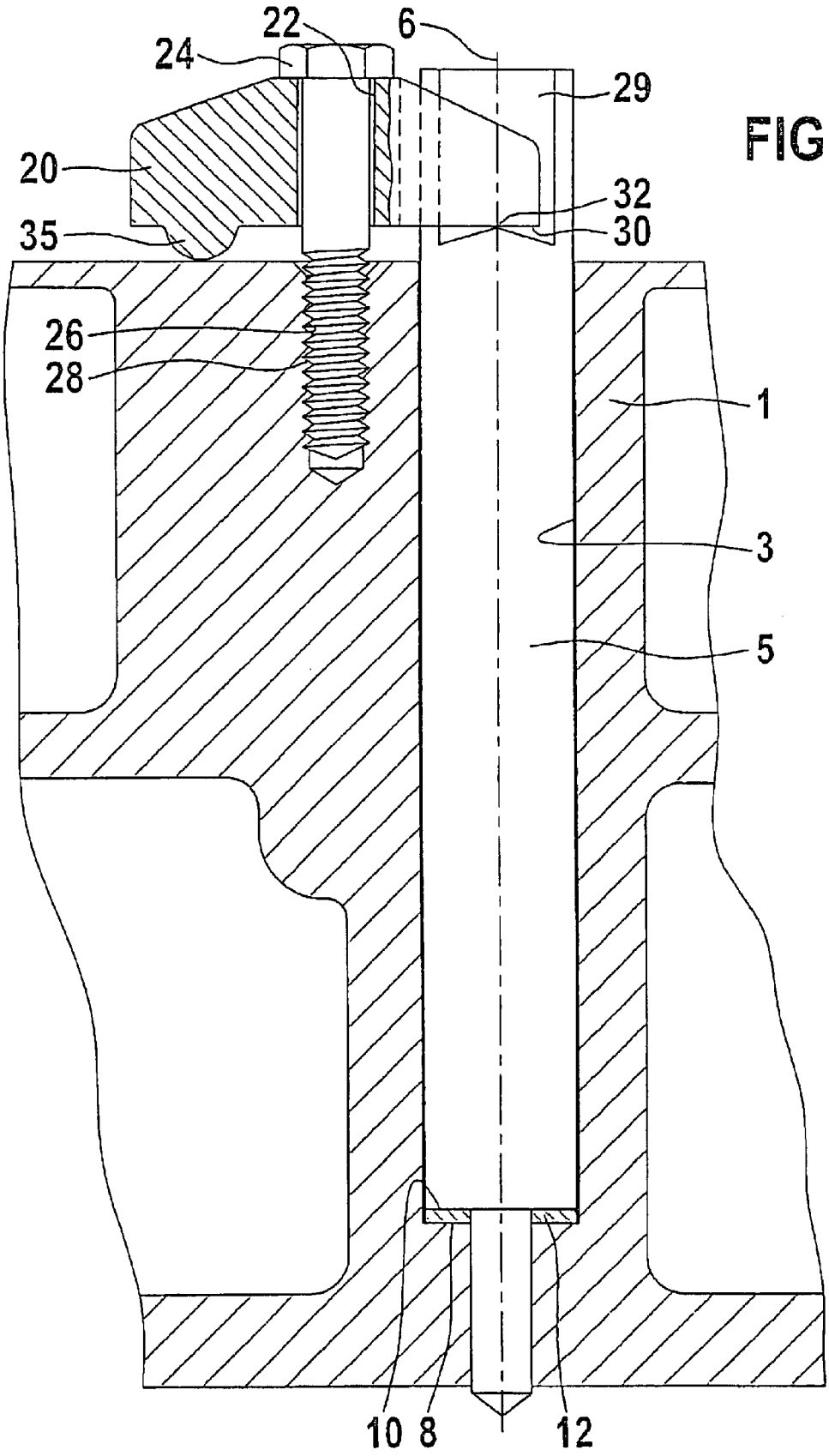
FIG. 1 is a longitudinal section through the cylinder head of an internal combustion engine, with a fuel injection valve disposed in it using the fastening device of the invention.

In FIG. 1, a longitudinal section through the cylinder head of an internal combustion engine is shown. In the cylinder head 1 of the engine, which is not otherwise shown, there is a bore 3, which is embodied in stepped form, forming an annular step 8, the annular step 8 being oriented toward the combustion chamber. A fuel injection valve 5 is disposed in the bore 3; it has a longitudinal axis 6, and on its outer jacket face, an annular shoulder 10, with which the fuel injection valve 5 rests, with the interposition of a sealing disk 12, on the annular step 8 of the bore 3. On the substantially cylindrically embodied end, remote from the combustion chamber, of the fuel injection valve 5, two diametrically opposed flat faces 29, 29' are embodied. For the sake of simplification, the connections for the fuel and other connections of the fuel injection valve 5 are not shown in the drawing.

Figure 2:
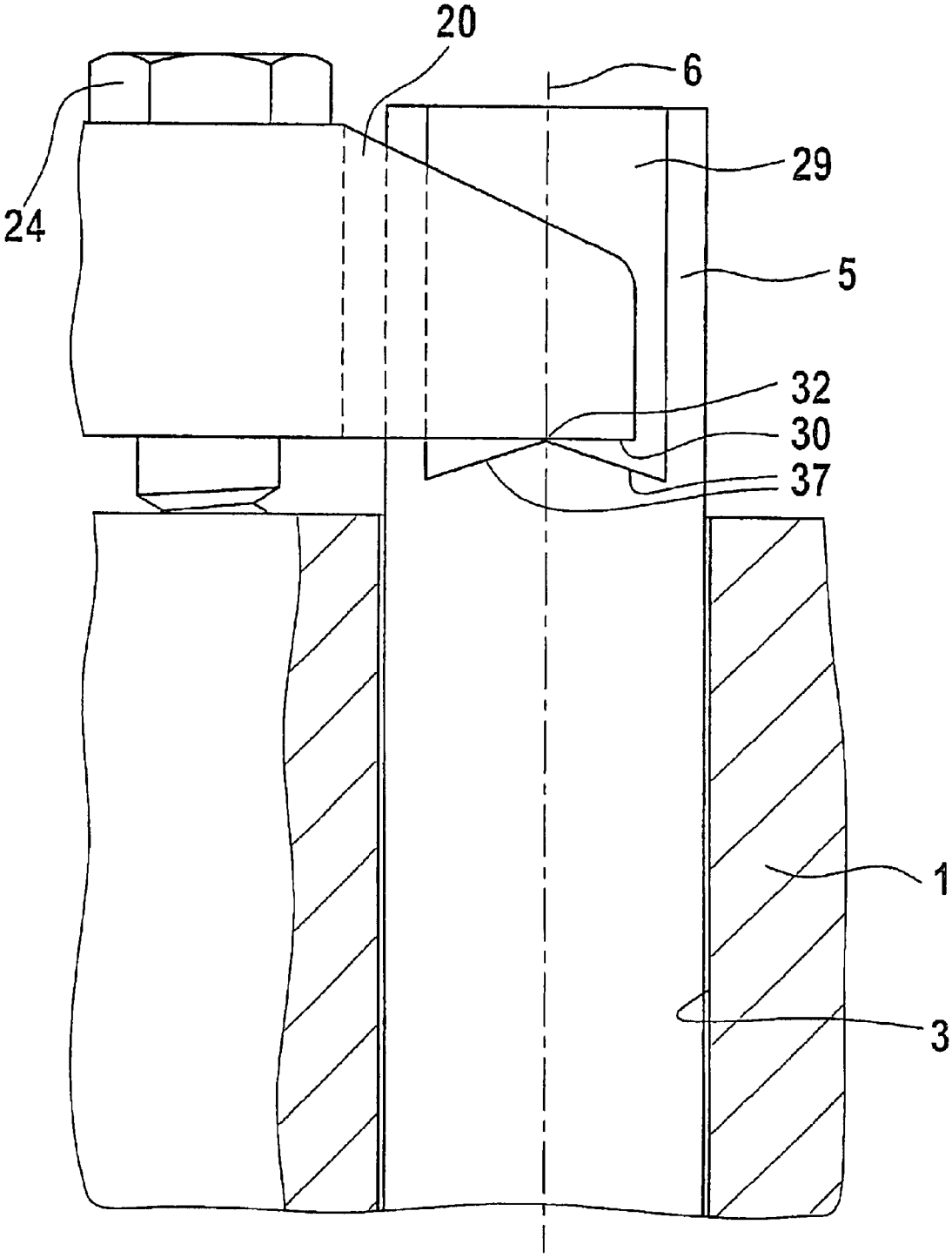
FIG. 2 is an enlargement of FIG. 1 in the region of the support point of the fuel injection valve.

A clamping jaw 20, which is embodied as a two-armed lever, is disposed on the side of the cylinder head 1 remote from the combustion chamber. The clamping jaw 20 has a central bore 22, through which a clamping screw 24 is passed, that has a male thread 28 on its end. The clamping screw 24 is screwed with the male thread 28 into a female thread 26 in the cylinder head 1, so that by way of a suitable torque on the clamping screw 24, a fastening force can be exerted on the clamping jaw 20, which presses the clamping jaw in the direction of the cylinder head 1. The clamping jaw 20 is braced, by its lever remote from the fuel injection valve 5, on a counterpart bearing 35 on the cylinder head 1. The lever portion oriented toward the fuel injection valve 5 has a support face 30, with which the clamping jaw 20 rests on a support point or edge 32 of the fuel injection valve 5. FIG. 2 shows an enlargement of FIG. 1 in the region of this support point 32. The end toward the combustion chamber of the flat face 29 is pointed, like a gable, by means of two chamfers 37. The chamfers 37 form a ridge, which forms the straight, linear support point 32. As a result of the fastening force of the clamping screw 24, the clamping jaw 20 exerts a force on the fuel injection valve 5 with which the fuel injection valve is pressed by its annular shoulder 10 against the annular step 8.

Figure 3:
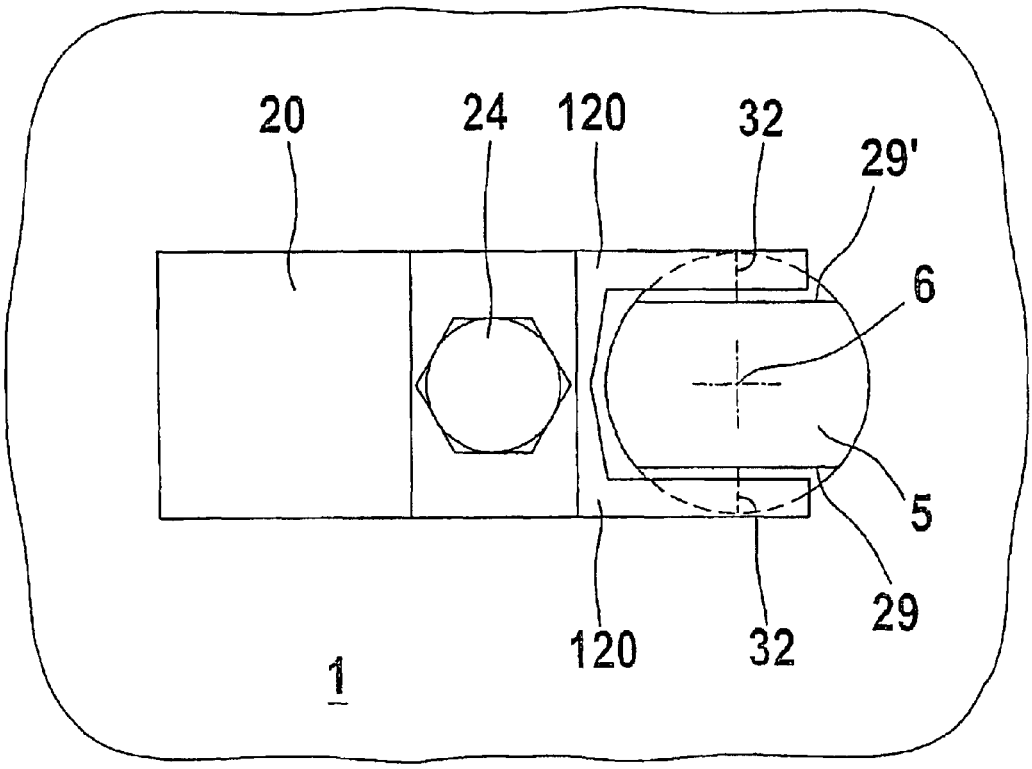
FIG. 3 is a top view on the fastening device and the cylinder head.

The further flat face 29', diametrically opposite the flat face 29 shown in FIG. 2, is identical to the first flat face 29. To that end, FIG. 3 shows a top view on the clamping jaw 20 and the corresponding portion of the cylinder head 1. On its end toward the fuel injection valve 5, the clamping jaw 20 is forked, so that two forked arms 120 are created. Each of the two forked arms 120 has a support face 30, each of which is braced on a respective support point 32 of the fuel injection valve 5. As a result, the fastening force on the fuel injection valve 5 is introduced both in the direction of the linear support point 32 and perpendicular to it, symmetrically, into the fuel injection valve 5.

It is decisive in this respect that both support points 32 are in the same plane as the longitudinal axis 6. Only in this way is it assured that the fastening force will be introduced precisely symmetrically into the fuel injection valve 5, so that the annular-disklike shoulder 10 is pressed uniformly over its entire circumference against the annular step 8.

Figure 4:
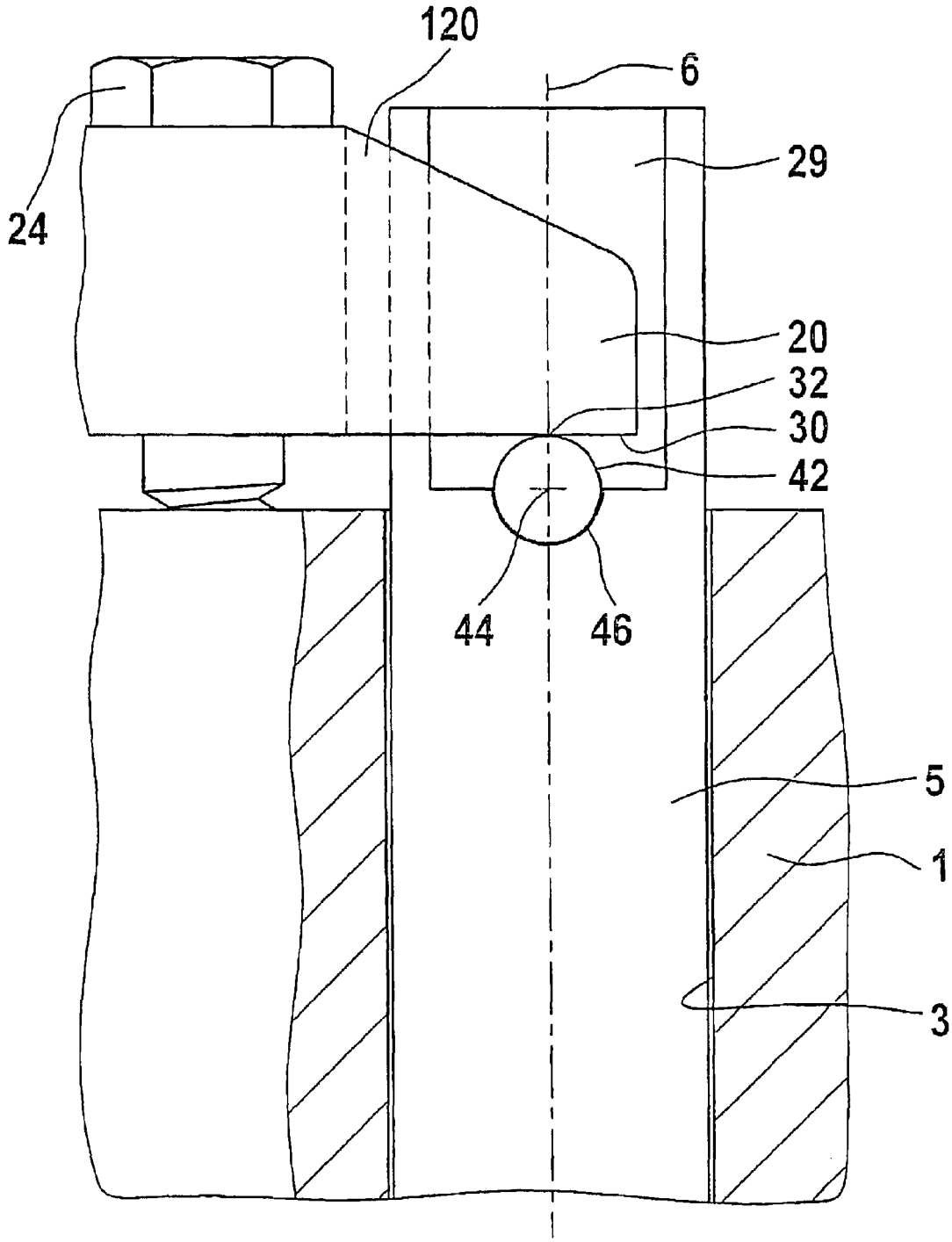
FIG. 4 is a view similar to FIG. 2, showing a further exemplary embodiment.

FIG. 4 shows the same portion as FIG. 2, for a further exemplary embodiment. On the end toward the combustion chamber, a semicylindrical recess 46 is embodied at the end of the flat face 29, and a support cylinder 42 which has an axis 44 is supported in this recess. The support cylinder 42 has the same diameter as the hemispherical recess 46, so that it is supported rotatably about its axis 44 in the recess 46. The axis 44, in its imaginary extension, intersects the longitudinal axis 6 of the fuel injection valve 5. The clamping jaw 20 rests with its support face 30 on a jacket line of the support cylinder 42, so that this jacket line forms the linear support point 32. This support point 32 in the form of a jacket line, in its imaginary extension, intersects the longitudinal axis 6 of the fuel injection valve 5, so that here as well, the introduction of force precisely in the plane of the longitudinal axis 6 can be achieved. If the clamping jaw 20 shifts horizontally, that is, perpendicular to the axis 44 of the support cylinder 42 or perpendicular to the longitudinal axis 6, then the support cylinder 42 can rotate in the recess 46, and as a result no transverse forces on the fuel injection valve 5 are created. Provision can also be made for the support cylinder 42 to be secured to the fuel injection valve 5 by means of a screw, which penetrates the support cylinder 42 at its center in the direction of the axis 44. On the diametrically opposite side of the fuel injection valve 5, just as in the case of the ridgelike support point 32, a second support cylinder 42 is disposed, on which the other forked end 120 of the clamping jaw 20 rests.

Figure 5:
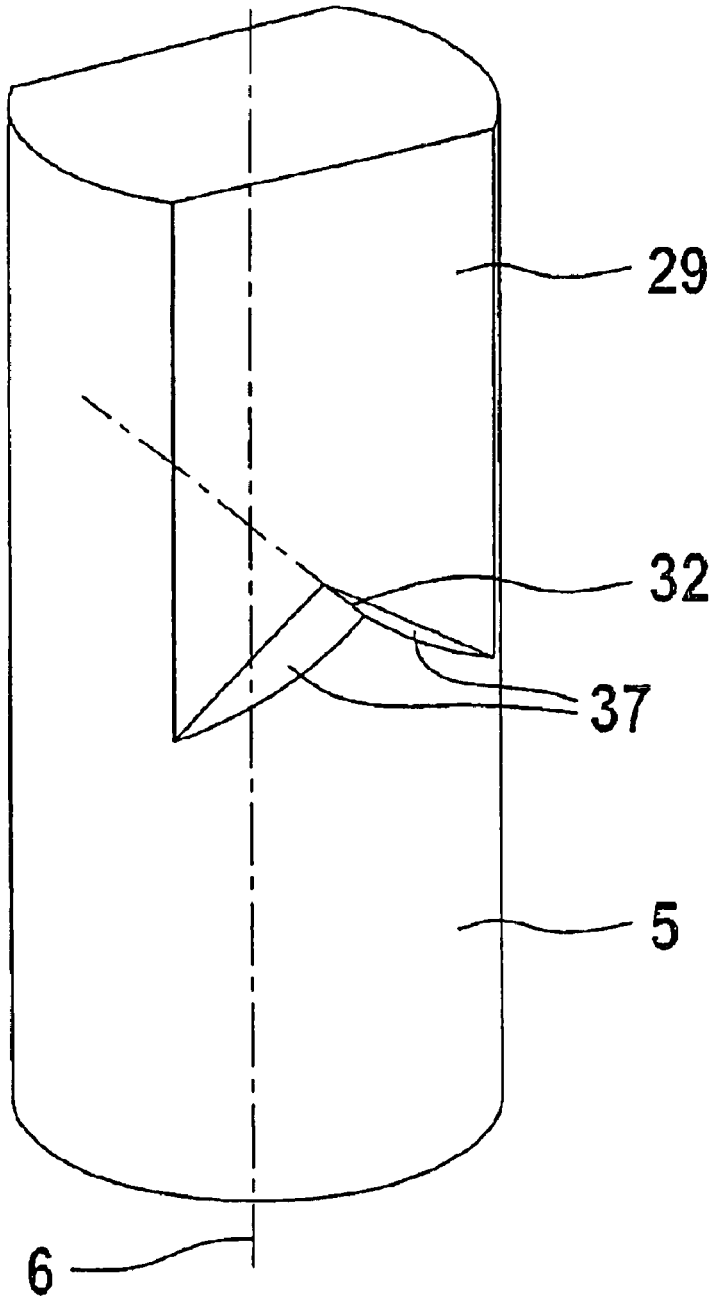
FIG. 5 is a perspective view of the end region, remote from the combustion chamber, with the support point of the invention.

FIG. 5 once again illustrates the embodiment of the flat face 29 on the fuel injection valve 5. In FIG. 5, the end region remote from the combustion chamber of the fuel injection valve 5 is shown, but for the sake of simplicity the clamping jaw 20 and the cylinder head 1 have been omitted from the drawing. How the chamfers 37 and of the ridge between the chamfers 37 that forms the linear support point 32 are embodied is now clearly shown. In FIG. 5, an extension of the linear support point 32 is shown, which intersects the longitudinal axis 6 of the fuel injection valve 5. The longitudinal axis 6 and the extension of the support point 32 thus define a plane that is a plane of symmetry of the fuel injection valve 5.

The fastening force can be introduced in still other ways into the clamping jaw 20, instead of with a clamping screw. For instance, a clamping device, tension spring or other device can be considered that is capable of exerting a sufficient fastening force on the clamping jaw.

Besides the embodiment of the support point as a linear ridge on both sides of the fuel injection valve 5, it can also be provided that the chamfers 37 extend over the entire width of the fuel injection valve 5; as a result, the correspondingly formed ridge forms a diameter of the fuel injection valve 5. In that case, the clamping jaw 20 is no longer embodied as forked on its support face 30 but instead has only a flat support face 30. This embodiment will be considered above all whenever the fuel connection and other connections, such as electrical terminals, feed laterally into the fuel injection valve 5.

The foregoing relates to preferred exemplary embodiments of the invention, it being understood that other variants and embodiments thereof are possible within the spirit and scope of the invention, the latter being defined by the appended claims.

What is claimed is:

1. A clamping device for fastening a fuel injection valve (5), having a longitudinal axis (6), in a bore (3) in the cylinder head of an internal combustion engine, the clamping device comprising, a clamping jaw (20) having at least one support face (30), a linear support point (32) on the injection valve, the linear support point (32) being defined by chamfers (37) intersecting to form a linear ridge extending in a straight line perpendicular to and lying in a plane containing the longitudinal axis (6) of the injection valve (5), and means applying a fastening force pressing the support face (30) of the clamping jaw (20) against the linear support point (32).

2. The clamping device of claim 1, the support face (30) is embodied in planar form.

3. The clamping device of claim 1, wherein the clamping jaw (20) comprises an elongated two-armed lever on one end of which the support face (30) is embodied and the other end of which rests at least indirectly on the cylinder head (1), and wherein the fastening force is introduced between the two ends of the clamping jaw (20).

4. The clamping device of claim 1, wherein one ridgelike support point (32) is formed on each of two diametrically opposed sides, relative to the longitudinal axis (6), of the fuel injection valve (5).

5. The clamping device of claim 4, wherein the end of the clamping jaw (20) resting on the fuel injection valve (5) is forked, and one support face (30) is embodied on each forked end (120).

6. A clamping device for fastening a fuel injection valve (5), having a longitudinal axis (6), in a bore (3) in the cylinder head of an internal combustion engine, the clamping device comprising, a clamping jaw (20) having at least one support face (30), a linear support point (32) on the injection valve, the linear support line (32) being defined by a jacket line of a support cylinder (42) supported on the injection valve (5) and having a longitudinal axis (44) intersecting and lying in the same plane as the longitudinal axis (6) of the injection valve (5), and means applying a fastening force pressing the support face (30) of the clamping jaw (20) against the support cylinder (42).

7. The clamping device of claim 6, wherein two support cylinders (42) are disposed coaxially one after the other on the fuel injection valve (5), and one support cylinder (42) is located on each side of the fuel injection valve (5).

* * * * *